US010526866B2

(12) United States Patent
Ferg

(10) Patent No.: US 10,526,866 B2
(45) Date of Patent: Jan. 7, 2020

(54) CASING EXPANSION FOR WELL PLUGGING

(71) Applicant: ConocoPhillips Company, Houston, TX (US)

(72) Inventor: Thomas Eugene Ferg, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 130 days.

(21) Appl. No.: 15/351,185

(22) Filed: Nov. 14, 2016

(65) Prior Publication Data

US 2017/0145782 A1 May 25, 2017

Related U.S. Application Data

(60) Provisional application No. 62/257,308, filed on Nov. 19, 2015.

(51) Int. Cl.

| | |
|---|---|
| ***E21B 33/13*** | (2006.01) |
| ***E21B 29/00*** | (2006.01) |
| ***E21B 33/134*** | (2006.01) |
| ***E21B 43/10*** | (2006.01) |
| ***E21B 43/114*** | (2006.01) |
| ***E21B 47/00*** | (2012.01) |

(52) U.S. Cl.

CPC ..... *E21B 33/13* (2013.01); *E21B 29/002* (2013.01); *E21B 33/134* (2013.01); *E21B 43/103* (2013.01); *E21B 43/105* (2013.01); *E21B 43/114* (2013.01); *E21B 47/00* (2013.01); *E21B 47/0005* (2013.01)

(58) Field of Classification Search

CPC .... E21B 33/13; E21B 47/0005; E21B 33/134; E21B 43/114; E21B 43/103; E21B 47/00; E21B 43/105; E21B 29/007; E21B 29/002

See application file for complete search history.

(56) References Cited

U.S. PATENT DOCUMENTS

| | | | | |
|---|---|---|---|---|
| 7,086,477 | B2 | 8/2006 | Duggan | |
| 2004/0112609 | A1* | 6/2004 | Whanger et al. | E21B 29/00 166/380 |
| 2010/0170675 | A1* | 7/2010 | Daigle et al. | E21B 29/00 166/298 |
| 2012/0061097 | A1* | 3/2012 | O'Connor et al. | E21B 23/00 166/381 |
| 2014/0027118 | A1* | 1/2014 | DeLange et al. | E21B 23/00 166/297 |
| 2014/0110136 | A1 | 4/2014 | Li | |
| 2015/0315865 | A1* | 11/2015 | Bohler | E21B 29/005 |

(Continued)

FOREIGN PATENT DOCUMENTS

| | | |
|---|---|---|
| WO | 2000037766 | 6/2000 |

OTHER PUBLICATIONS

International Search Report for parent case, App. No. PCT/US16/61898, dated Jan. 31, 2017.

(Continued)

*Primary Examiner* — Brad Harcourt

(74) *Attorney, Agent, or Firm* — Boulware & Valoir

(57) ABSTRACT

The present invention discloses a method of plugging a well that relies on casing expansion to plug uncemented casing sections, rather than milling out the casing or perforate wash and cement (PWC).

20 Claims, 4 Drawing Sheets

(56) References Cited

U.S. PATENT DOCUMENTS

2016/0024896 A1* 1/2016 Johnson et al. ..... E21B 43/108

OTHER PUBLICATIONS

Akisanya AR, Khan Fu, Deans WF, Wood P. Cold hydraulic expansion of oil well tubulars, International Journal of Pressure Vessels and Piping (2011).
Plugging and Abandonment of Oil and Gas Wells Paper #2-25 of the NPC North American Resource Development Study (2011).

* cited by examiner

CASING EXPANSION FOR WELL PLUGGING

PRIOR RELATED APPLICATIONS

This application claims priority to U.S. Ser. No. 62/257,308, filed on Nov. 19, 2015, incorporated by reference herein in its entirety for all purposes.

FIELD OF THE INVENTION

The invention relates to methods, systems and devices for plug and abandonment operations to shut down a well.

BACKGROUND

Well abandonment is an inevitable stage in the lifespan of a well. As oilfields world-wide continue to shift from asset to liability, wells must be dismantled carefully to minimize environmental threats and meet all regulatory requirements.

In oilfield jargon, the phrase "plug and abandon" refers to preparing a well to be closed permanently. The earliest oil wells were abandoned without any plugging, but the first plugging requirements were enacted by Pennsylvania in the 1890s. However, prior to modern regulations set in the '50s, many wells were abandoned with plugs consisting of brush, wood, paper sacks, linen or any other material that could be pushed into a well to form a basis for the dumping of one or two sacks of cement to "plug" the well. Current procedures are significantly more disciplined however.

Plugging and abandonment (P&A) regulations vary to some degree among states, but all state regulations prescribe the depth intervals that must be cemented, as well as the materials that are allowed in plugging practices. FIG. 1 provides a comparison of the plugging requirements in different states with a focus on the key elements of plugging the oil and gas strata, plugging the fresh water zone, and surface casing plugging.

Most states require that cement plugs be placed and tested across any open hydrocarbon-bearing formations, across all casing shoes, across freshwater aquifers, and perhaps several other areas near the surface, including the top 20 to 50 ft [6 to 15 m] of the wellbore. The well designer may choose to set bridge plugs in conjunction with cement slurries to ensure that higher density cement does not fall in the wellbore. In that case, the bridge plug would be set and cement pumped on top of the plug through drillpipe, and then the drillpipe withdrawn before the slurry thickened. FIG. 2A shows a well before and after a typical P&A operation.

It is also possible to P&A only part of a well. One cost effective way to enhance production is to permanently abandon the bottom of the well, but use the existing slot to sidetrack the well to reach new payzones. The cost can often be cut in half when sidetracking an existing well instead of drilling a new horizontal well. This process is known as "slot recovery." FIG. 2B shows an example of a zone abandonment, where only the bottom of a well is plugged.

The plugging process usually requires a workover rig and cement pumped into the wellbore and can take two days to a week, depending on the number of plugs to be set in the well. The P&A work takes considerable capital to complete and provides zero return on the investment for the oil companies. Indeed, the cost to P&A a well can vary by many millions of dollars depending on location, and whether the well is offshore or onshore. Thus, most wells are plugged at the lowest cost possible following the minimum requirements set forth by regulatory bodies.

As older oil and gas fields are re-entered to exploit bypassed reserves or to develop reserves deemed uneconomical in the past, the abandoned wells within the field can present potential problems. As these old fields are reentered to apply enhanced oil recovery (EOR) technologies, such as steam, solvent, or $CO_2$ flooding, the reservoir pressure is again increased due to the injection of these EOR fluids. When this higher pressure reaches unplugged or poorly plugged wells, there is a chance that the formation fluids will bypass the plugging materials and migrate uphole. This can cause problems with the fresh water aquifers in the area by allowing gas, oil or salt water to contaminate the fresh water. Furthermore, the oldest pre-regulation wells were never plugged and many old wells are poorly documented, their location and plugging status uncertain.

P&A responsibility does not end with the P&A activities either, nor does it end with sale of the property. If an abandoned well leaks, the operator will be held responsible for damage and to repair and remediate the well and the site. Thus, P&A activities are very important, even if P&A operations present only costs, not income.

In recognition of its strength and low permeability, cement has been typically used to create a seal between formations or to seal off the surface of the wellbore. Other materials which do not offer the same strength or durability as cement, including drilling mud, gel, and clay, can be used to fill in the spaces between cement plugs. Additionally, many states allow the use of mechanical bridge plugs in lieu of a large cement plug since the bridge plug is extremely strong and nearly completely impermeable. However, mechanical plugs are susceptible to corrosion, and therefore the regulations typically require the bridge plugs to be capped by a specified amount of cement.

The effectiveness of a permanent abandonment plug is measured by its ability to bridge the wellbore cross section, both vertically and horizontally, including all annuli, with a plugging medium that can withstand the harsh environment to which it is exposed. Indeed, regulators are increasingly demanding that operators remove sections of casing so that a cement plug may be set that is continuous across the entire borehole in a configuration often referred to as "rock-to-rock."

Because cement must go all the way to the formation, the typical procedure is to mill out the casing and remove tons of swarf before spotting the cement. In addition to being expensive and time-consuming, this operation prevents re-entry into the wellbore and the swarf is highly abrasive to all equipment.

A new method was recently introduced that perforates uncemented casing, washes the annular space, and then mechanically places the cement across the wellbore cross section, sometimes in a single run. Although an improvement on milling, this perforate, wash, and cement (PWC) system, it can be tricky to fill all of the gaps because of the blind spots between perforations.

Thus, what is needed in the art are better methods for P&A that create a reliable barrier, are cost effective, and are safe, fast and easy to perform. The ideal method would also be easier to reverse.

SUMMARY

The present disclosure provides systems, methods and devices for plug and abandonment operations, wherein casing is cut at or near the top of a plugging interval and the casing expanded to meet the formation. The quality of contact is ascertained using e.g., a cement bond log tool, which is an acoustic tool that measures the loss of acoustic energy as it propagates through the casing and is capable of detecting empty channels or gaps. Once a solid connection between the expanded casing and formation is confirmed, the hole can be cement filled and thus plugged. Otherwise, the plugging operations can proceed in the typical manner, as described above and as is known in the art.

When the well is cemented, the quality can be evaluated, e.g, with a cement bond logging tool, ultrasonic tool, gamma ray log, neutron log and/or by pressurized leak tests. Both sonic and ultrasonic cement evaluations are defined as acoustic logging measurements. The response of the acoustic logging tool is related to the acoustic properties of the surrounding environment; casing, fluid, cement and formation, and any gaps in the cement plug can easily be detected. Density logs (typically gamma ray based) or neutron logs can also be used to ascertain the quality of the plug.

This novel method of P&A provides several advantages, including one or more of:

Potential reduction in P&A time from 30-80%.

Well bore stability is maintained to a greater extent.

The majority of the P&A operation is conducted within cased hole.

Swarf is not created, which would require handling and disposal.

Blowout preventer and other equipment are not exposed to the detrimental effects of swarf.

A large variety of tools are available to cut the tubular, including chemical, jet, abrasive, and explosive cutters and/or methods. Further, the tube could also be cut by milling, although this is less preferred because of the swarf that is generated in milling. However, small amounts may be acceptable, and here only a very small amount of tubing needs be milled. Alternatively, reverse milling can sometimes be done, letting the swarf fall down hole.

At least three different methods currently exist for performing the in-situ expansion of casing in an oil or gas well, and additional methods may yet be developed. These include: (i) roller cone tools whereby a radially expanding tool is rotated and pulled simultaneously through the pipe causing the pipe to expand, (ii) solid cone tools which are hydraulically and/or mechanically pulled (or pushed) through the pipe, and (iii) hydraulic expansion. The choice of expansion method depends on the operational requirements. Both the roller and solid cone expansion methods are strain-controlled and have greater maximum achievable diametrical expansion than the hydraulic method, which is stress-controlled.

Exemplary tools are also described, for example in WO2000037766, "PROCEDURES AND EQUIPMENT FOR PROFILING AND JOINTING OF PIPES"; U.S. Pat. No. 7,086,477 "Tubing expansion tool," and US20140110136, "DOWNHOLE CASING EXPANSION TOOL AND METHOD OF EXPANDING CASINGS USING THE SAME."

Depending on the technology used, expansion can occur at the couplers as well. In other embodiments, where it may be difficult to expand through the joint couplings, the P&A procedure is performed between joint couplings. Since joints are typically 24-40 feet long, there is typically plenty of space for a P&A operation within a given joint. As yet another alternative, gaps behind the couplings can be backfilled with cement merely by cutting a hole at the coupling, and allowing cement to be squeezed out of the hole, filling any gap behind the couplers.

In more detail, the invention includes any one or more of the flowing embodiments in any combinations thereof:

A method of plugging a well or portion thereof, said method comprising:

cutting an uncemented casing at a top of a plugging interval;

expanding said uncemented casing below said cut until an expanded tubing touches a reservoir wall surrounding said section in 360° throughout said plugging interval;

onfirming that said expanded tubing touches the reservoir in 360° throughout said plugging interval; and cementing said plugging interval. Preferably, the plug is then tested to confirm integrity.

A method of plugging a portion of uncemented casing in a well, the method comprising cutting a top section of uncemented casing and expanding uncemented casing below said cut top section to make expanded tubing, confirming contact between the expanded tubing and a reservoir wall surrounding said expanding tubing, plugging said cut and said expanded tubing with a plug material, and testing said plug to confirm it is leakproof at a maximum anticipated pressure.

A method of plugging a portion of uncemented casing in a well, the method comprising cutting a top section of uncemented casing and expanding uncemented casing below said cut to make expanded tubing, confirming contact between the expanded tubing and a reservoir surrounding said expanded tubing, perforating, cutting or milling said expanded tubing over any gap between said expanded tubing and said reservoir, and plugging said cut and said expanded tubing with a plug material. If there is a gap, the plug material will also travel through the cut or milled section over said gap, thereby filling that gap.

A method of plugging a portion of uncemented casing in a well, the method comprising cutting a top section of uncemented casing and expanding uncemented casing below said cut to make expanded tubing, confirming contact between the expanded tubing and a reservoir surrounding said expanded tubing, perforating, cutting or milling said expanded tubing over any gap between said expanded tubing and said reservoir, placing a mechanic plug or drilling mud at or near the bottom of said expanded tubing, and plugging said cut and said expanded tubing with a plug material.

A method of P&A of a portion of uncemented casing in a well, the method comprising cutting a top section of uncemented casing in a wellbore and expanding uncemented casing below said cut to make expanded tubing, confirming contact between the expanded tubing and a reservoir surrounding said expanded tubing, perforating, cutting or milling said expanded tubing over any gap between said expanded tubing and said reservoir, cleaning said wellbore, optionally placing a mechanical plug or drilling mud at or near the bottom of said expanded tubing, and plugging said cut and said expanded tubing with a plug material.

Any method as herein described, wherein said cut is made with a chemical cutter, a jet cutter, an external cutter, or a mill.

Any method as herein described, wherein said confirming step is performed by obtaining a cement bond log (CBL), a density log or a porosity log.

Any method as herein described, wherein said CBL is obtained using a sonic or ultrasonic cement bond logging tool.

Any method as herein described, wherein said confirming step indicates a gap between said expanded tubing and said reservoir, and said expanded tubing is cut and at least partially removed at said gap, and additional cement is added to said gap.

Any method as herein described, wherein said expanded tubing is at least partially removed by perforation, milling or cutting.

Any method as herein described, wherein said expanding step is performed with a tubing expansion tool.

Any method as herein described, wherein said tubing expansion tool is a hydraulic tubing expansion tool, a solid cone tubing expansion tool, a roller cone tubing expansion tool, or an axial rotating tubing expansion tool.

Any method as herein described, wherein said plugging material comprises Portland cement, a geopolymer, an unconsolidated plugging material, Bingham-plastic unconsolidated plugging material, or a thermosetting polymer. Combinations of those could also be used.

As used herein, a "tubular" is a generic term pertaining to any type of oilfield pipe, such as drill pipe, drill collars, pup joints, casing, production tubing and pipeline.

As used herein, a "joint" is a single length of pipe, usually referring to drillpipe, casing or tubing. While there are different standard lengths, the most common drillpipe joint length is around 30 ft [9 m]. For casing, the most common length of a joint is 40 ft [12 m].

As used herein, a "tubular string" or "tubing string" or "casing string" refers to a number of joints, connected end to end (one at a time) so as to reach down into a well, e.g., a tubing string lowers a sucker rod pump to the fluid level.

As used herein "swarf" are the fine chips or coils of metal produced by milling the casing or other tubulars.

As used herein, "cutting" a tubular refers to making a 360° cut in a tubular, usually at or near the top of a desired plugging interval, such that the tubular is severed into two separate pieces. Cutting a tubular produces a "cut," below which the tubular is expanded to meet the reservoir wall. Any technology that can be used to produce a cut can be used, including any known cutting tool, mill, and the like.

As used herein, a "cutter" is any downhole tube that can be used to cut tubing, which is typically done when a tool is stuck, in order to retrieve the tubing string and send down fishing tools. There are a number of different types of such tools, some of which are named herein.

An "external cutter" is a type of cutter. The external cutter slips over the fish or tubing to be cut. Special hardened metal-cutters on the inside of the tool engage on the external surfaces of the fish. External cutters are usually used to remove the topmost, possibly damaged, portion of a fish to enable an overshot, or similar fishing tools, to engage on an undamaged surface.

As used herein, a "chemical cutter" is a type of cutter run on wireline to sever tubing at a predetermined point when the tubing string becomes stuck. When activated, the chemical cutter use a small explosive charge to forcefully direct high-pressure jets of highly corrosive material in a circumferential pattern against the tubular wall. The nearly instantaneous massive corrosion of the surrounding tubing wall creates a relatively even cut with minimal distortion of the tubing, aiding subsequent fishing operations.

As used herein, a "jet cutter" is a type of cutter, generally run on wireline or coiled tubing, that uses the detonation of a shaped explosive charge to cut the surrounding tubing or casing wall. The cutting action leaves a relatively clean cut surface, although the explosive action tends to flare the cut ends.

As used herein, an "abrasive water jet cutter" used abrasives suspended in a jet of water to cut the tubing.

As used herein, an "expansion tool" is a downhole tool used to expand the diameter of the tubular. This is done either hydraulically, by applying mud pressure, or mechanically, by pulling the conical/tapered expansion tool, or by a rotating axial force.

As used herein a "cement bond log" or "CBL" is a representation of the integrity of the cement job, especially whether the cement is adhering solidly to the outside of the casing. The log is typically obtained from one of a variety of sonic-type tools. The newer versions, called cement evaluation logs, along with their processing software, can give detailed, 360-degree representations of the integrity of the cement job, whereas older versions may display a single line representing the integrated integrity around the casing. The term CBL is intended to include this and any other newer forms of cement bond log, even when combined with other techniques, such as gamma ray logs. In this disclosure, the CBL is used to determine that a good connection is made between the expanded tube and the wellbore wall/formation.

A CBL can be generated with a "cement bond tool" or "cement bond logging tool" or CBLT. Cement bond logging tools measure the bond between casing and the cement placed in the annulus between the casing and the wellbore. The measurement is usually made by using acoustic methods using either sonic or ultrasonic tools. It may also be possible to use a density log or neutron log to ascertain the presence of gaps.

By "cement" used as a noun herein what is meant is any plugging material that is used to barricade or plug a well, including e.g., Portland cement, silica fumed cement, unconsolidated well plugging materials, Bingham-plastic materials, geopolymer cement (made of aluminum and silicon), Sandabag™, Thermaset™ (a non-reactive polymer with a curing process activated by temperature), and the like.

By "cement" or "cementing" as a verb what is meant is any method of sealing the wellbore with a cement or other plugging material that meets applicable regulatory requirements. Thus, the term includes squeeze cementing, and all its variations (low pressure squeeze, high pressure squeeze, Bradenhead squeeze, squeeze tool technique, running squeeze, hesitation squeeze), plug cementing, two plug cementing, balanced plug cementing, dump bailer method, and the like.

By "wellbore" what is meant is the drilled hole or borehole, including the openhole or uncased portion of the well.

By "geopolymer cement" what is meant is a new type of cement slurry that is made of aluminum and silicone.

By "leak testing" what is the application of pressure to detect leaks in a well barrier.

By "thermoset cement" what is meant is a non-reactive polymer developed in the nineties as an alternative plugging material to conventional cement. The polymer sets under heat.

As used herein a "plugging interval" refers to that portion of a wellbore that must be plugged to prevent migration of fluids. A well may have several plugging intervals that need to be separately plugged.

As used herein, a "blocking device" is any device used to prevent cement or other plugging material from falling downhole, e.g., it provides a stable base on which to set the plug. This can be a mechanical device, such as basket, inflatable basket, plug, packer, or a metal alloy plug formed by melting Bismuth alloy, and the like. The blocking device could also be non-mechanical device such as a cement plug, barite plug, sand plug, a bolus of extra heavy mud, combinations thereof, or any other non-mechanical blocking device. Since this only acts as a base for a permanent plug, it is not required to act as a permanent plug by itself, and the requirements are less stringent. The bottom of the well can even serve as a blocking device if near enough to the plug zone. The use of non-mechanical blocking devices may be beneficial to fill and irregular space, but a mechanical device can be set somewhat below the plugging zone with efficacy too.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| API | American Petroleum Institute which promulgates tubing standards, etc. |
| CBL | Cement bond log |
| CBLT | Cement bond logging tool |
| P&A | Plug and abandonment |
| PWC | Perforation, wash and cement |

DETAILED DESCRIPTION

The invention relates to new methods, systems and apparatus for plugging a well.

The first step when starting a well abandonment operation is removing existing tools. This can be done using an existing drilling or conventional workover rig with the capacity to pull out of hole all downhole equipment previously used by the operator, such as production tubing, downhole pumps and packers. If tool removal is not possible due to stuck or lost equipment, well abandonment strategies have to be revised and approved by concerned authorities.

After the removal operation, the wellbore typically needs to be cleaned from fill, scale and other debris. To clean the wellbore, it is flushed with a circulation fluid having sufficient density to control pressure and with the physical properties that enable the removal of debris. Dependent on the specific conditions, additional tools or additives may be required to successfully clean the hole.

The principal technique applied to prevent cross flow between permeable formations is plugging of the well, creating an impermeable barrier between two zones. Well plugs are being used for several different operations in the oil & gas industry, such as lost circulation control, formation testing, directional/sidetrack drilling, zonal isolation and well abandonment. The inventive method can be use used anywhere plugging is required.

Figure 1:
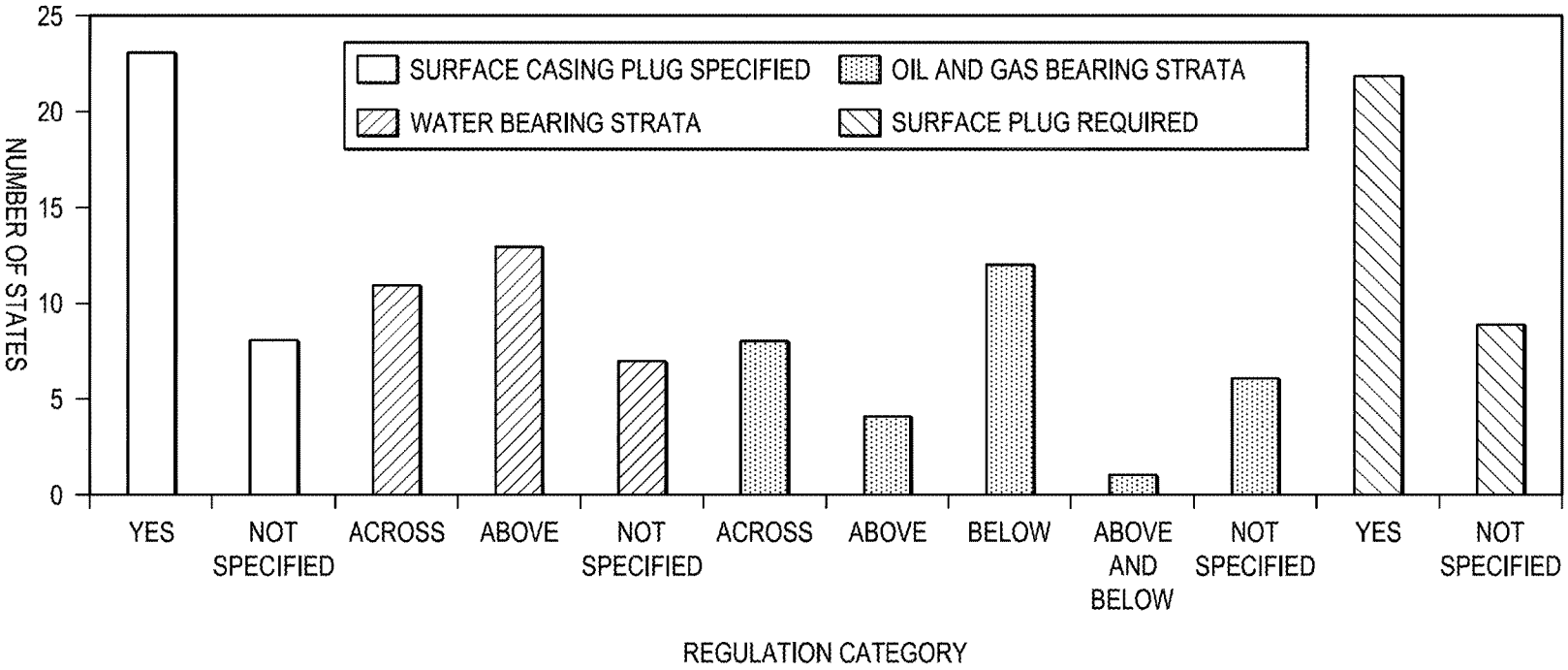
FIG. 1 provides a state comparison of P&A regulations.
Figure 2A:
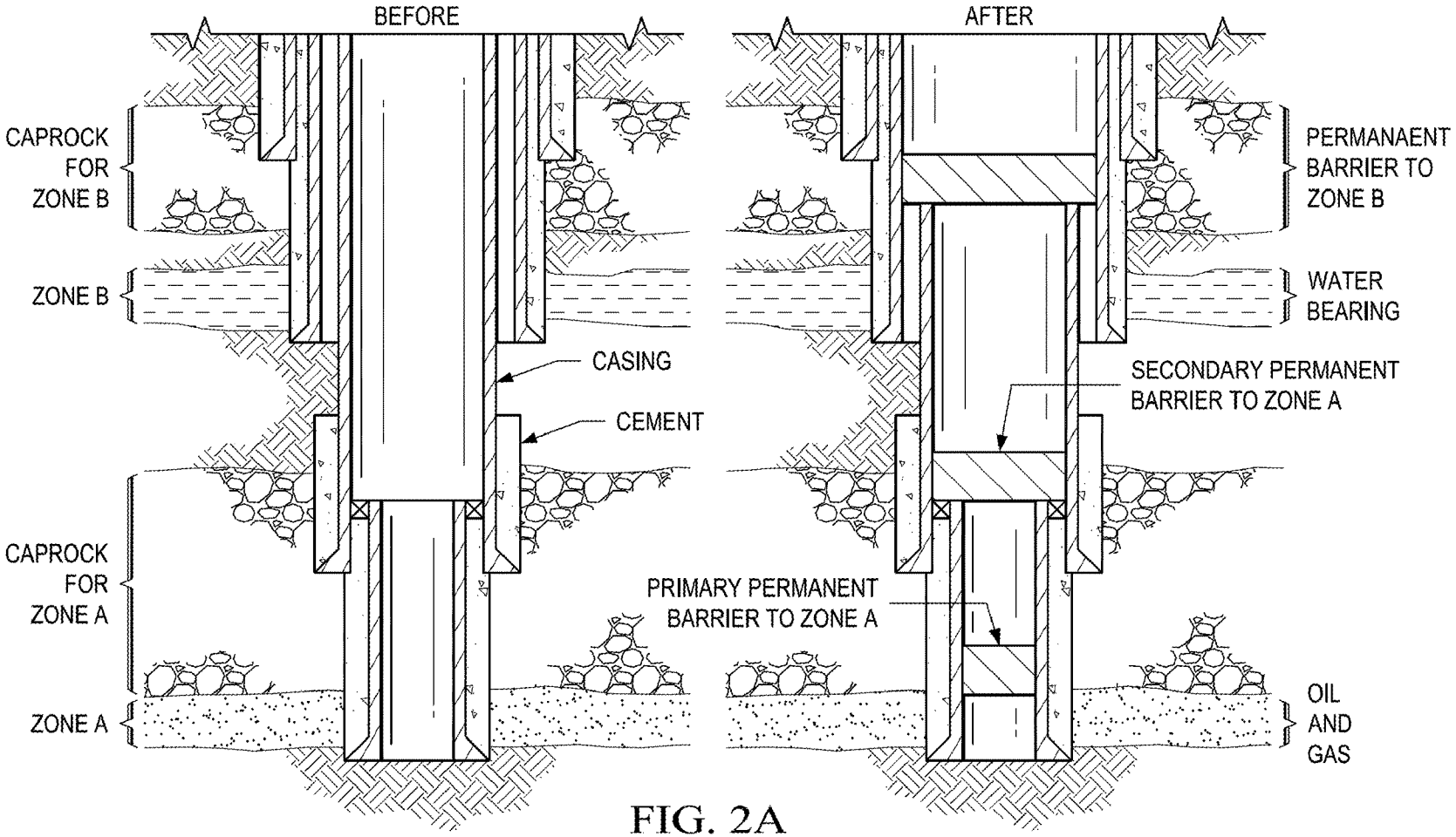
FIG. 2A provides a simplified schematic of a typical well before and after P&A.
Figure 2B:
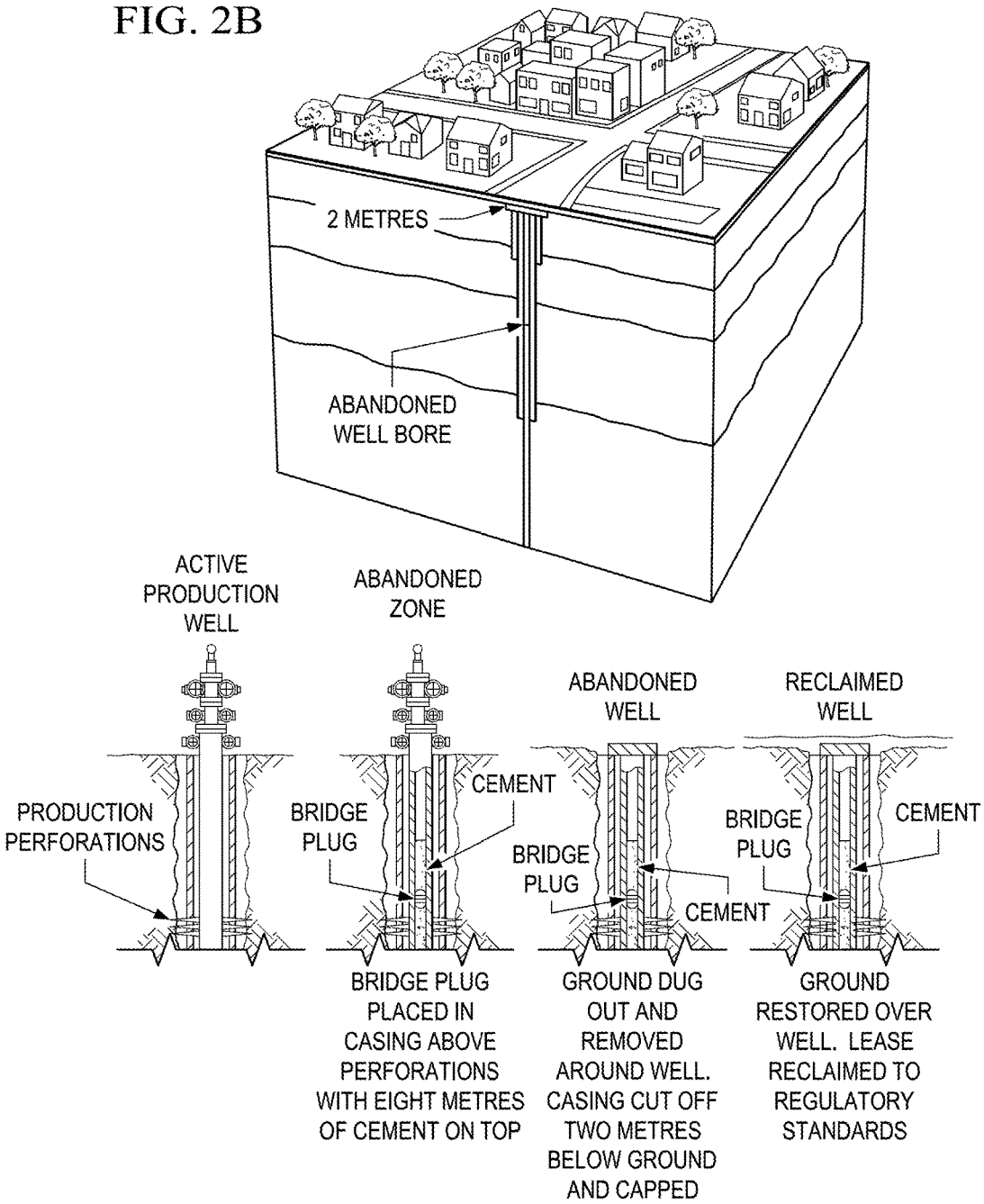
FIG. 2B shows various types of P&A operations, including P&A of a lower zone, versus P&A of the whole well. In preferred P&A operations, the well is still reclaimable should new technology or higher gases allow a well to be reopened.
Figure 3:
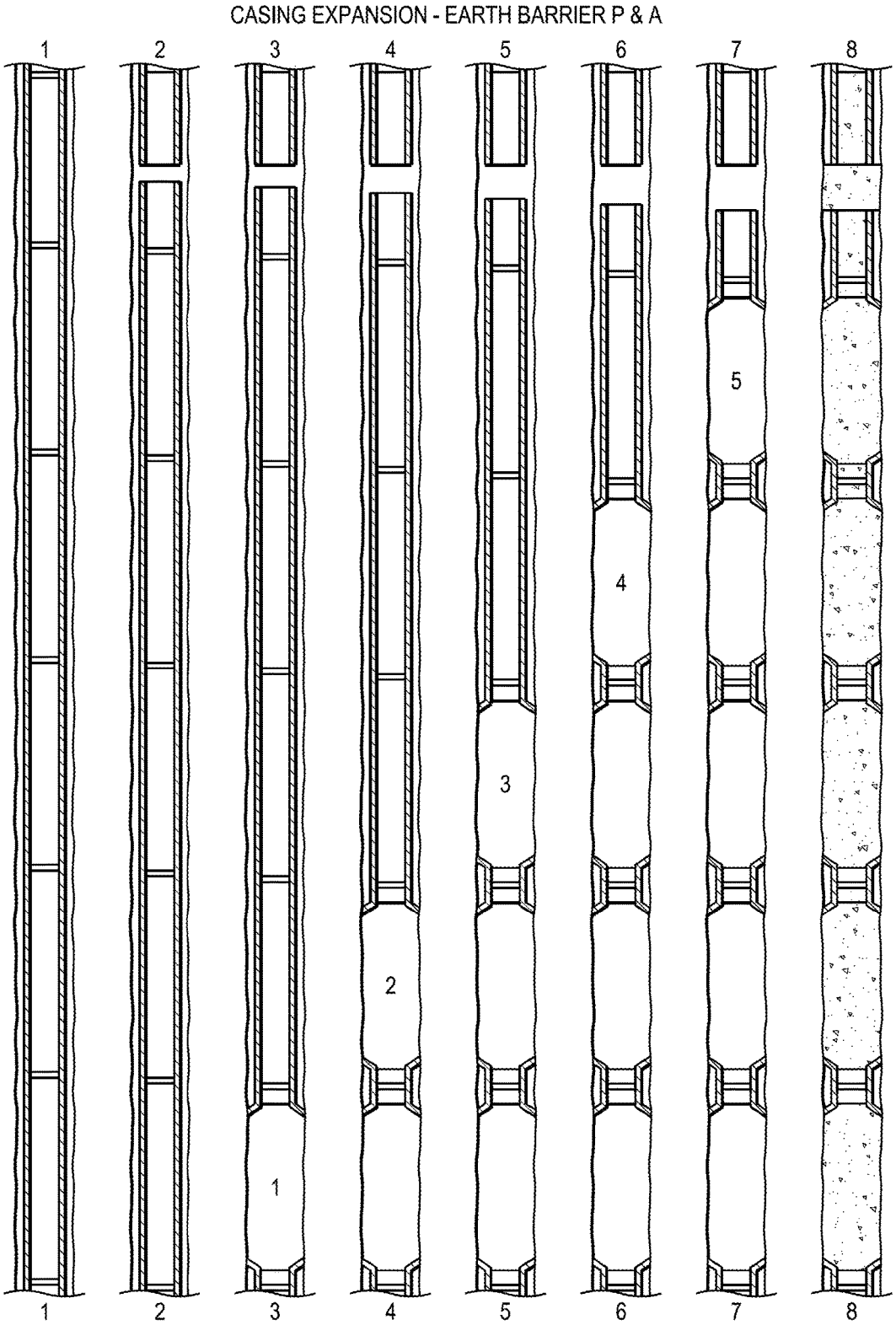
FIG. 3 illustrates the method of the invention.

Different zones in the well may use different plugging techniques. Developed herein is a method of plugging free casing rock-to-rock, shown schematically in FIG. 3. In FIG. 3, a free casing is illustrated in panel 1, which needs to be plugged all the way to the wellbore wall.

In the past, this was done by milling out the casing, removing the swarf and cementing the wellbore, or by a perforation, wash and cement (PWC) process.

The disclosed method instead requires a cut at or near the top of the plugging interval as shown in panel 2. The cut is believed necessary because expansion shortens the overall string length, and the cut frees the tubulars for this movement.

Any method of cutting the tubular can be used, including external cutters, jet cutters, chemical cutters, mills and the like. However, a method that does not generate swarf is sometimes preferred, though not essential as reverse milling can be done, and in any event only a tiny amount of milling is required.

In panel three, the bottom-most joint of the plug interval is expanded so as to fill the well bore. Any method of expanding the tubular can be used, as suitable for the tubulars and couplers used in the well. Thus, cone expansion tools, roller cone expansion tools, hydraulic expansion tools or rotating axial force tools can all be used.

The joint expansion continues for all joints in panels 4-7. The expansion can include joint couplers, if possible, or can proceed only between couplings if non-expandable couplers were used.

Once all the joints are expanded, a cement bond log or cement evaluation log is obtained to confirm that the tubulars are fully expanded and completely contract the wellbore. Alternatively, a CBL can be obtained after each joint is expanded, but this may require many more downhole trips and is less preferred.

If there are any gaps, the tubular can be perforated, cut or milled at that location, such that the gap can be cement filled. However, this is expected to be rare if the wellbore is well formed and the method does not disturb the wellbore.

The final step is then to cement the plug interval, as shown in panel 8. If needed, the wellbore can be cleaned before such cementing to remove e.g., swarf, sludge, and the like. Furthermore, if needed, the wellbore can be plugged at or near the bottom of the expanded tubing with a mechanical plug, packer, basket, inflatable to contain the cement. Alternatively, drilling mud can be used to fill the hole to the bottom of the plugging interval.

Portland cement is most commonly used to plug wells. It satisfies the essential criteria of an adequate plug—it is durable, low-permeable and relatively inexpensive. Furthermore, it is easy to pump in place, has a reasonable setting time and is capable of tight bonding to the formation and well casing surface preventing fluid flow along these interfaces.

API specifies that an adequate cement plug should have a compressive strength of at least 1,000 psi and a maximum liquid permeability of 0.1 mD. The different classes of API cement are based on the downhole temperature at the depths where the cement is to be placed. Cement slurries are designed to meet API definitions and recommended practices, as well as to satisfy its specific performance criteria. To this purpose additives (e.g., sand, bentonite or dispersants) may be added to the Portland cement to enhance specific properties. Dispersants reduce the water/cement ratio, providing higher strengths and lower permeability. Accelerators may also be added to the cement to increase the early strength of the plug. However, in many parts of the world, API well cement is difficult or impossible to obtain and construction cements are applied.

The cement is applied under some pressure, so as to squeeze the cement into any perforation and fractures in the wellbore. Pressures will vary according to the type of formation and type of squeeze technique employed, but would typically be low pressure squeeze using a pressure below the fracture pressure. Typical ranges would be 500-1500 psi surface squeeze pressure, but can be lower in certain wells and higher in others, depending on fracture strength, minerology, tools employed, and the like.

Although Portland cement is most commonly used to plug wells, other materials can also be used. For example, unconsolidated well plugging materials, Bingham-plastic material, geopolymer cements (made of aluminum and silicon), Sandabag, Thermaset (a non-reactive polymer with a curing process activated by temperature), and the like, can be used as plugging materials.

The cement level is usually observed after cement has set for 24 hours. If the cement has fallen back, the casing is typically re-filled with cement back to the top of the plugging interval.

Typically, once the plug is placed and set, it is then tested. Any suitable test can be performed to confirm the integrity of the barrier(s) or as dictated by applicable regulations. After the well is plugged, testing is required to ensure that the plug is a placed at the proper level and provides zonal isolation. The plug can be verified by tagging its top, pump pressure testing or swab testing. Typically a leak test is performed. In the leak test a pressure is applied to the barrier equal to or higher than the maximum differential pressure that the barrier can be exposed to. The acceptable leak rates shall be zero, unless other values are given. Alternatively, or in addition to a leak test, another CBL can be run. In addition, a gamma ray-neutron log may be required by some states. These tests may confirm the quality and placement of the cement.

Typically, once all of the required plugs are placed and set, the well is then capped, usually with a steel plate, and then a plugging report is submitted to the requisite authorities.

The following documents are incorporated by reference in their entirety:

Akisanya A R, Khan F U, Deans W F, Wood P. Cold hydraulic expansion of oil well tubulars, International Journal of Pressure Vessels and Piping (2011), doi: 10.1016/j.ijpvp.2011.08.003, available online at http://aura.abdn.ac.uk/bitstream/2164/2226/1/Akisanya_et_al._2011_Accepted_manuscript.pdf.

PLUGGING AND ABANDONMENT OF OIL AND GAS WELLS Paper #2-25 of the NPC North American Resource Development Study (2011), available online at http://www.npc.org/Prudent_Development-Topic_Papers/2-25_Well_Plugging_and_Abandonment_Paper.pdf

What is claimed is:

1. A method of plugging a well or portion thereof, said method comprising:

a) cutting an uncemented casing at a top of a plugging interval;

b) expanding said uncemented casing below said cut until an expanded tubing touches a reservoir wall surrounding said section in 360° throughout said plugging interval;

c) confirming that said expanded tubing touches the reservoir in 360° throughout said plugging interval; and d) cementing said plugging interval.

2. The method of claim 1, wherein said cut is made with a chemical cutter.

3. The method of claim 1, wherein said cut is made with a jet cutter.

4. The method of claim 1, wherein said cut is made with an external cutter.

5. The method of claim 1, wherein said cut is made with a mill.

6. The method of claim 1, wherein said confirming step is performed by obtaining a cement bond log (CBL), a density log or a porosity log.

7. The method of claim 6, wherein said CBL is obtained using a sonic cement bond logging tool.

8. The method of claim 6, wherein said CBL is obtained using an ultrasonic cement bond logging tool.

9. The method of claim 1, wherein said confirming step indicates a gap between said tubing and said reservoir, and said tubing is cut and at least partially removed at said gap, and additional cement is provided through said cut and into said gap.

10. The method of claim 9, wherein said tubing is at least partially removed by perforation, milling or cutting.

11. The method of claim 1, wherein said expanding step is performed with a tubing expansion tool.

12. The method of claim 11, wherein said tubing expansion tool is a hydraulic tubing expansion tool.

13. The method of claim 11, wherein said tubing expansion tool is a solid cone tubing expansion tool.

14. The method of claim 11, wherein said tubing expansion tool is a roller cone tubing expansion tool.

15. The method of claim 11, wherein said tubing expansion tool is an axial rotating tubing expansion tool.

16. A method of plugging a portion of uncemented casing in a well, the method comprising cutting a top section of uncemented casing and expanding uncemented casing below said cut top section to make an expanded tubing, confirming contact between said expanded tubing and a reservoir wall surrounding said expanded tubing, plugging said cut and said expanded tubing with a plug material, and testing said plug to confirm it is leakproof at a maximum anticipated pressure.

17. A method of plugging a portion of uncemented casing in a well, the method comprising cutting a top section of uncemented casing and expanding uncemented casing below said cut to make expanded tubing, confirming contact between the expanded tubing and a reservoir surrounding said expanded tubing, perforating, cutting or milling said expanded tubing over any gap between said expanded tubing and said reservoir, and plugging said cut and said expanded tubing with a plug material.

18. A method of plugging and abandonment of a portion of uncemented casing in a well, the method comprising of cutting a top section of uncemented casing in a wellbore and expanding uncemented casing below said cut to make an expanded tubing, confirming contact between the expanded tubing and a reservoir surrounding said expanded tubing, perforating, cutting or milling said expanded tubing over any gap between said expanded tubing and said reservoir, cleaning said wellbore, placing either a mechanical plug or drilling mud at or near the bottom of said expanded tubing, and plugging said cut and said expanded tubing with a plug material.

19. A method of plugging a portion of uncemented casing in a well, the method comprising cutting a top section of uncemented casing such that said uncemented casing is severed at a cut, expanding uncemented casing below said cut to make expanded tubing, confirming contact between said expanded tubing and a reservoir surrounding said expanded tubing, perforating, cutting or milling said expanded tubing over any gap between said expanded tubing and said reservoir, placing a blocking device at or near the bottom of said expanded tubing, plugging said cut and said expanded tubing and said any gap with a plug material to form a plug, and testing said plug to confirm that said plug is leakproof at a maximum anticipated pressure.

20. The method of any one of claims 16-19, wherein said plugging material comprises Portland cement, a geopolymer, an unconsolidated plugging material, Bingham-plastic unconsolidated plugging material, or a thermosetting polymer.

* * * * *